US009976736B2

(12) United States Patent
Alfier et al.

(10) Patent No.: US 9,976,736 B2
(45) Date of Patent: May 22, 2018

(54) LIGHTING ASSEMBLY AND ASSOCIATED METHOD

(75) Inventors: Alberto Alfier, Vedelago (IT); Lorenzo Roberto Trevisanello, Abano Terme (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 426 days.

(21) Appl. No.: 14/232,291

(22) PCT Filed: Jul. 12, 2012

(86) PCT No.: PCT/EP2012/063724

§ 371 (c)(1),
(2), (4) Date: Jan. 13, 2014

(87) PCT Pub. No.: WO2013/007796

PCT Pub. Date: Jan. 17, 2013

(65) Prior Publication Data

US 2014/0140078 A1 May 22, 2014

(30) Foreign Application Priority Data

Jul. 14, 2011 (IT) ..... TO2011A0624

(51) Int. Cl.
*F21S 4/00* (2016.01)
*F21V 21/00* (2006.01)
(Continued)

(52) U.S. Cl.
CPC ..... *F21V 29/22* (2013.01); *F21V 19/0055* (2013.01); *F21V 23/005* (2013.01);
(Continued)

(58) Field of Classification Search
CPC ..... F21V 29/22; F21V 29/70; F21V 29/76; F21V 23/005; F21V 23/06;
(Continued)

(56) References Cited

U.S. PATENT DOCUMENTS 8,354,684 B2 * 1/2013 West ..... 257/98
2006/0141851 A1 * 6/2006 Matsui et al. ..... 439/490
(Continued)

FOREIGN PATENT DOCUMENTS

CN 101101093 A 1/2008
TW 200910627 A 3/2009
(Continued)

OTHER PUBLICATIONS

International Search Report of PCT/EP2012/063724 dated Oct. 10, 2012.

(Continued)

*Primary Examiner* — Jason Moon Han
(74) *Attorney, Agent, or Firm* — Viering, Jentschura & Partner mbB

(57) ABSTRACT

A lighting assembly includes: a heat sink having a mounting surface for a light source; a light source board having said light source thereon, said light source board being arranged against said mounting surface and having an outer perimeter edge, and a drive board carrying drive circuitry for said light source, said drive board being fixed onto said heat sink with said light source board sandwiched therebetween, said drive board having an aperture with an inner edge complementary to said outer edge of said light source board, whereby said light source is left uncovered by said drive board, and wherein: said inner edge of said drive board has an inwardly protruding frame formation with said outer perimeter edge of said light source board abutting against said frame formation, and said light source board has a thickness whereby said drive board and said mounting surface have a clearance therebetween.

19 Claims, 4 Drawing Sheets

(51) Int. Cl.

| | |
|---|---|
| ***F21V 29/00*** | (2015.01) |
| ***F21V 19/00*** | (2006.01) |
| ***F21V 23/06*** | (2006.01) |
| ***F21V 23/00*** | (2015.01) |
| ***F21V 29/70*** | (2015.01) |
| ***F21V 29/76*** | (2015.01) |
| *F21Y 115/10* | (2016.01) |

(52) U.S. Cl.

CPC ..... *F21V 23/006* (2013.01); *F21V 23/06* (2013.01); *F21V 29/70* (2015.01); *F21V 29/76* (2015.01); *F21Y 2115/10* (2016.08); *Y10T 29/4913* (2015.01)

(58) Field of Classification Search

CPC ..... F21V 19/0055; F21V 19/001; F21V 19/0015; F21V 19/003; F21V 19/0035; F21V 19/0045; F21V 19/005; F21V 23/004; F21V 29/20; F21V 29/71; F21V 29/713; F21Y 2101/02; Y10T 29/4913

USPC ..... 362/382, 249.02, 294, 311.02, 800; 29/832

See application file for complete search history.

(56) References Cited

U.S. PATENT DOCUMENTS

| | | | | |
|---|---|---|---|---|
| 2008/0008427 | A1 | 1/2008 | Takeda et al. | |
| 2009/0046469 | A1* | 2/2009 | Yang et al. | 362/310 |
| 2011/0069502 | A1* | 3/2011 | Hum | 362/373 |
| 2011/0090691 | A1* | 4/2011 | Markle et al. | 362/249.02 |

FOREIGN PATENT DOCUMENTS

| | | | |
|---|---|---|---|
| WO | 2004071143 | A1 | 8/2004 |
| WO | 2011046695 | A2 | 4/2011 |

OTHER PUBLICATIONS

European Office Action based on applicatopn No. 12738078.0 (6 pages) dated Feb. 25, 2015.

Chinese Office Action based on Application No. 201280034408.X (8 Pages and 9 Pages of English translation) dated Oct. 10, 2015 (Reference Purpose Only).

Chinese Office Action based on Application No. 201280034408.X(9 Pages and 11 pages of English translation) dated May 23, 2016 (Reference Purpose Only).

* cited by examiner

LIGHTING ASSEMBLY AND ASSOCIATED METHOD

RELATED APPLICATIONS

The present application is a national stage entry according to 35 U.S.C. § 371 of PCT application No.: PCT/EP2012/063724 filed on Jul. 12, 2012, which claims priority from Italian application No.: TO2011A000624 filed on Jul. 14, 2011, and is incorporated herein by reference in its entirety.

TECHNICAL FIELD

Various embodiments relate to lighting assemblies.

In various embodiments, the description may refer to LED lighting assemblies, for example of the multi-chip type.

BACKGROUND

During the manufacture of lighting assemblies, in particular for outdoor use, it is common to use, for example, LED light sources, for example of the multi-chip type, i.e. with several chips which are arranged on a metal panel and connected directly to a connector of the module without providing any "intelligence" within the circuit.

In indoor applications it is known to use assemblies of the Chip-on-Board (CoB) type which are glued directly onto the board (for example printed circuit board (PCB)) of the so-called light engine. The board is made with a high degree of planarity, with the subsequent application of conductive glue onto which the CoB module is applied. As soon as the glue has hardened, connection between the electrodes of the CoB module (i.e. the light source board on which the light source is arranged) and the PCB board (i.e. the drive board of the light source) is performed.

This method of operation may result in:

- a high degree of thermal resistance between the light source board and the associated heat sink, as a result of the presence of three interfaces, namely between: i) light source board (CoB)/glue, ii) glue/drive board and iii) drive board/heat sink;
- increase in the production time due to the manual bonding method; and
- the need to provide a casing for protecting the contacts of the light source board (CoB).

SUMMARY

Various embodiments provide lighting assemblies, for example of the LED type, able to be used, for example, for street lighting applications, which have modular characteristics and are able to provide one or more of the following advantages:

- reduction of the thermal resistance between the light source and the associated heat sink, for example by envisaging the possibility of mounting the board carrying the light source (CoB) directly onto the surface of the heat sink;
- compactness of the so-called light engine, in particular for street lighting applications;
- simplification of the mounting process, for example with regard to joining together of the light source board (e.g. CoB) and the drive board or light engine;
- availability of a standard structure which is stable and reliable as regards both mounting and heat dissipation;
- efficient adjustment of the tolerances between the mounted parts; and

- ease of use of the lighting module in an array.

According to the disclosure, various embodiments provide a lighting assembly having the characteristic features mentioned in the claims below. The disclosure also relates to a corresponding method.

Various embodiments offer one or more of the following advantages:

- minimum thermal resistance between the light source board (e.g. CoB) and the heat sink, achieved, for example, by using spring contacts which allow heat dissipation directly from the light source board to the heat sink; all of which with a consequent improvement in the performance of the radiation sources (for example of the LED type) and with the possibility of avoiding overheating of the drive board;
- possibility of simultaneous assembly of the light source board and the drive board as a stand-alone system, with consequent simplification of the installation process, linked to the fact of avoiding installing firstly the light source board and then the drive board;
- mechanical stability of the system over time owing, for example, to fixing performed by means of screwing onto the heat sink.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following description, various specific details aimed at providing an in-depth understanding of the embodiments are described. The embodiments may be implemented without one or more of the specific details or using other methods, components, materials, etc. In other cases, known structures, materials or operations are not shown or described in detail, so that the various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment. Moreover, particular forms, structures or characteristic features may be combined in any suitable manner in one or more embodiments.

The reference numbers used here are provided solely for the sake of convenience and therefore do not define the scope of protection or the range of application of the embodiments.

In the figures, the reference number 10 denotes overall a lighting assembly which can be used, for example, in a street lighting system.

In various embodiments the assembly 10 uses, as a light radiation source, an LED module.

Figure 1:
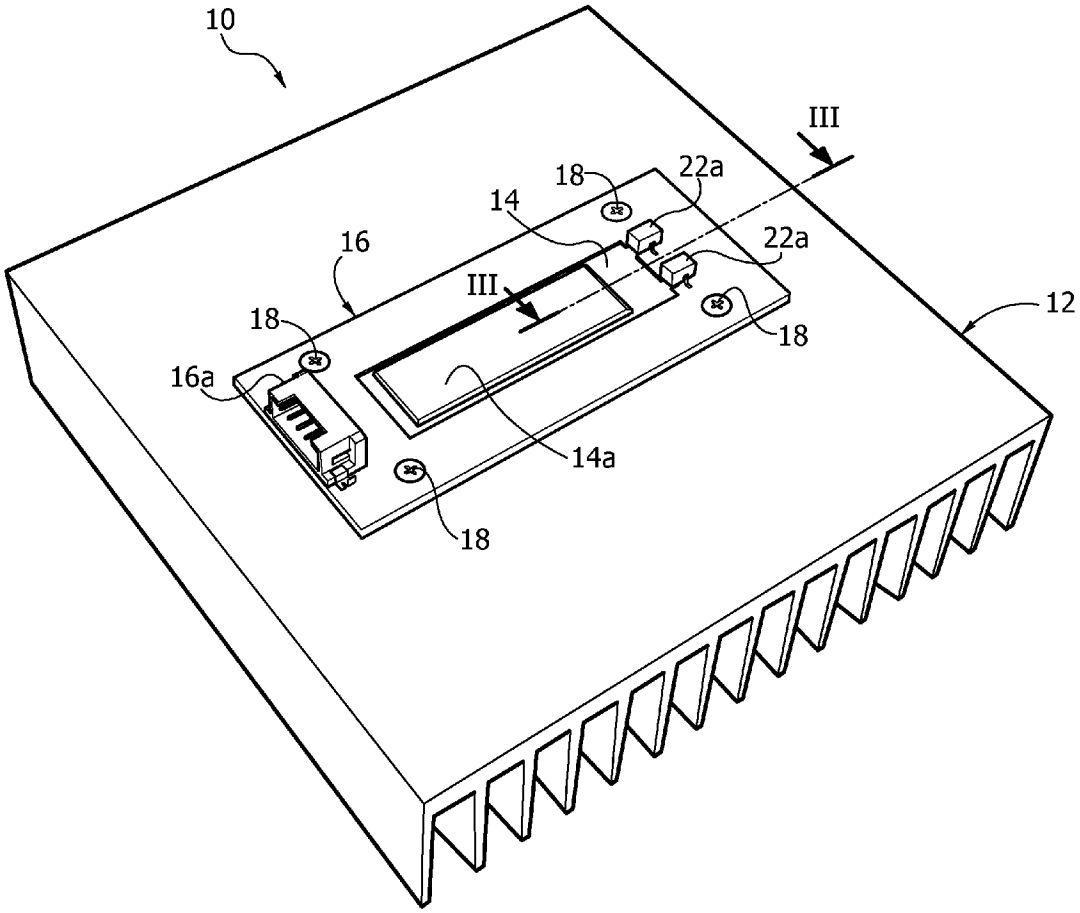
FIG. 1 is a general perspective view of an embodiment.

In various embodiments, the assembly 10 may comprise three parts:

- a heat sink 12, for example in the form of a metal plate finned in one side and having on the opposite side (top side in FIG. 1) a flat or substantially flat surface capable of acting as a mounting surface for a light source;
- a board 14 having, mounted thereon, a light source 14*a*, for example of the LED type, the assembled unit composed of the parts 14, 14*a* being able to be made, for example, using so-called Chip-on-Board (CoB) technology; and
- a drive board 16 able to be carry, mounted thereon, circuit components for driving the light source 14*a*; in various embodiments, the circuit components in question may be formed by electrical connecting strips or tracks which extend through the board 16 and lead to a connector 16*a*; in various embodiments, the aforementioned circuitry may comprise processing circuits, (so-called "intelligence") mounted on the board 16, which assumes the characteristics of a so-called light engine.

In various embodiments, the board 14 with the light source 14*a* may be sandwiched between the heat sink 12 and the "drive" board 16.

Figure 2:
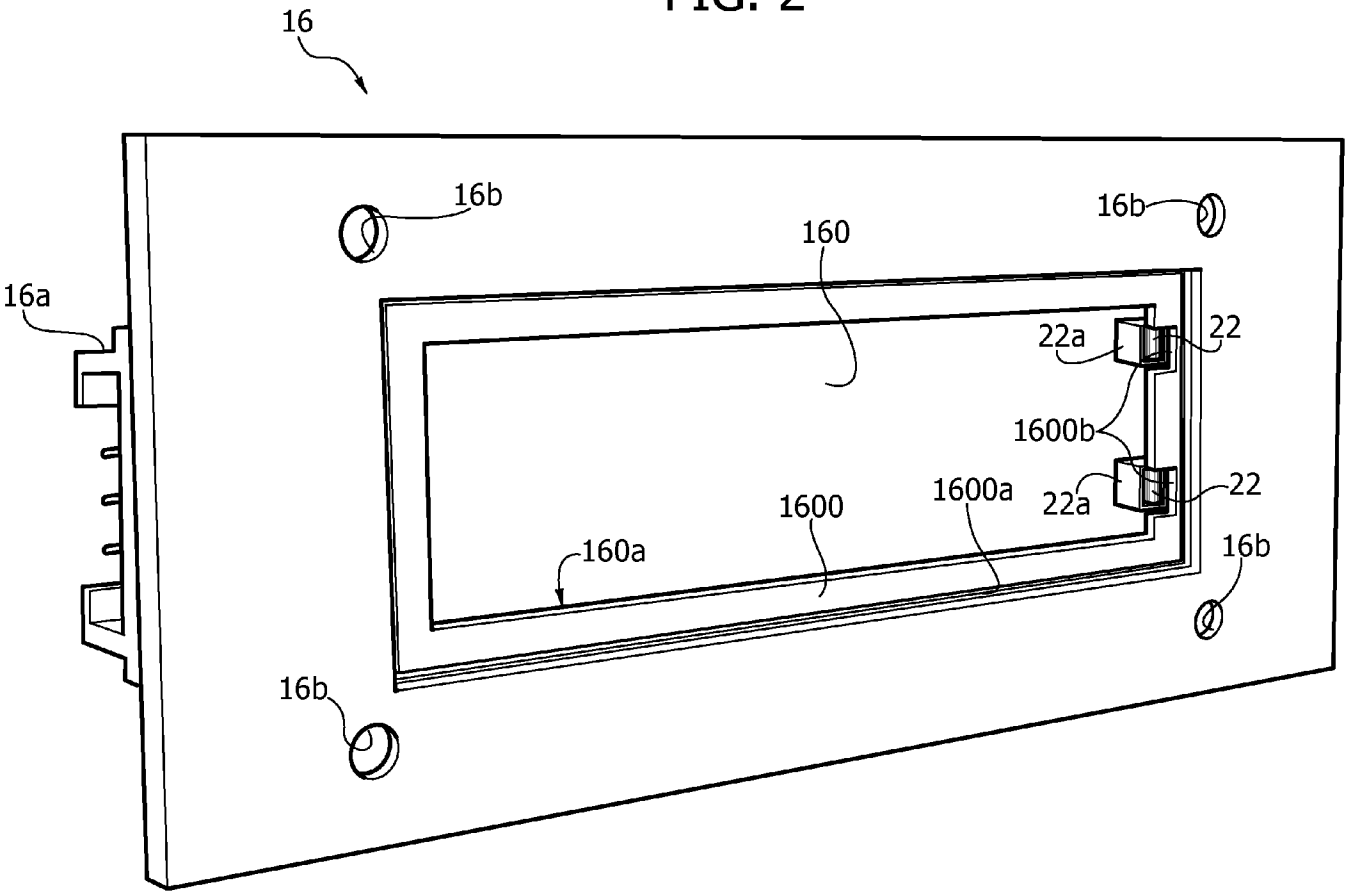
FIG. 2 is a view of some parts of an embodiment.

As can be seen more clearly in the view of FIG. 2, where the drive board 16 is shown on its own, in the example of embodiment considered here, the board 16 may be made with a rectangular form. Obviously, other forms such as a square, polygonal, mixtilinear or other form are possible.

In various embodiments, the board 16 may have an aperture 160 with an inner edge 160*a* having a progression (rectangular in the example of embodiment shown here) complementing the progression (in this case also rectangular) of the perimetral edge 140 of the board 14.

Figure 4:
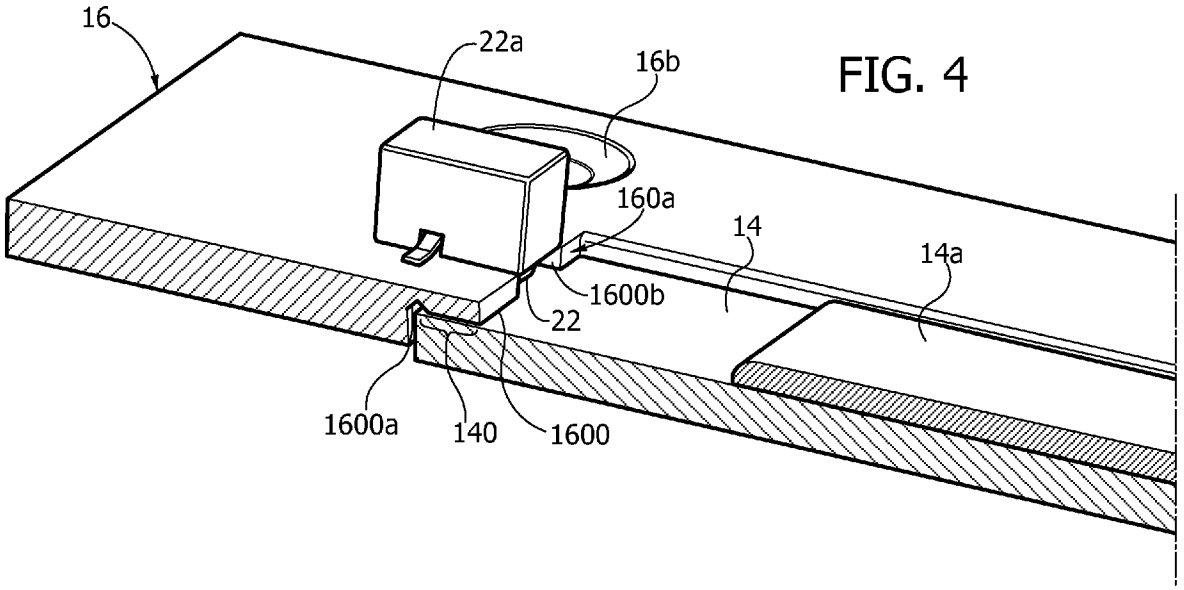
FIG. 4 shows parts of embodiments shown cross-sectioned.
Figure 5:
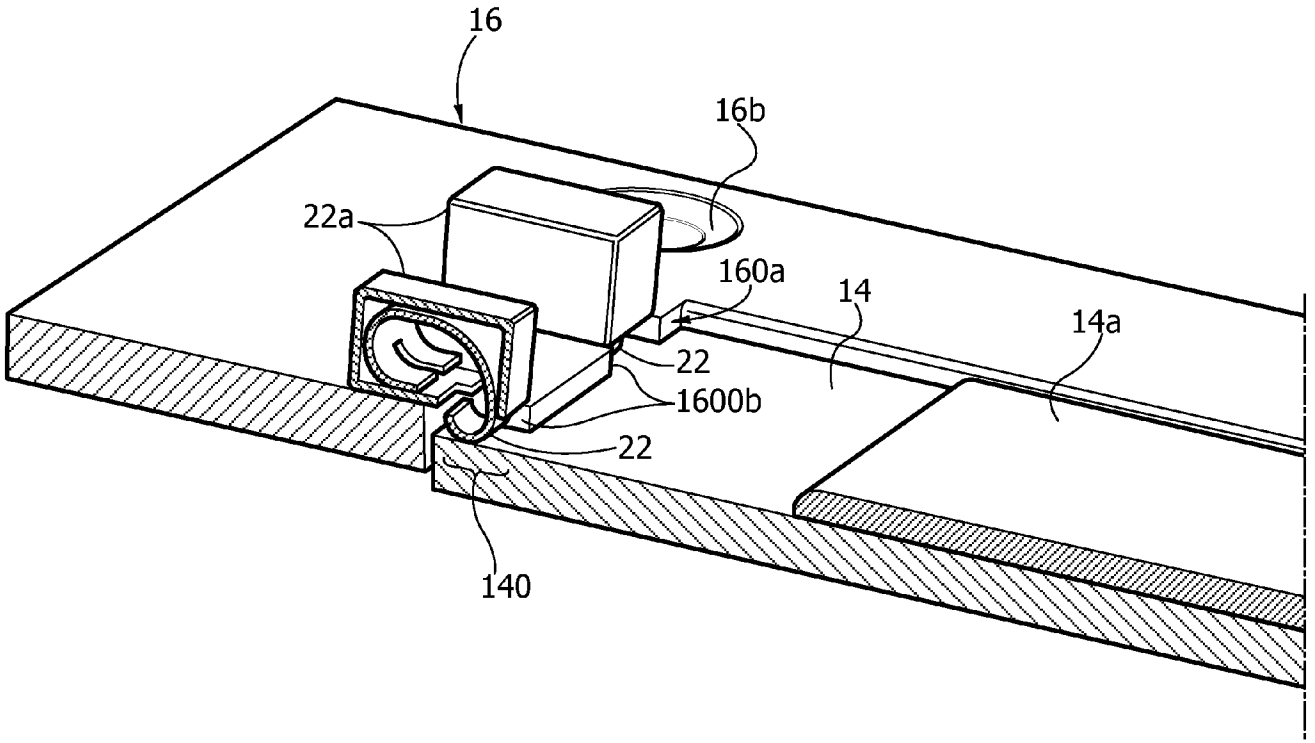
FIG. 5 shows, in a manner substantially similar to that of FIG. 4, some details of embodiments.

The views in FIGS. 4 and 5 show the assembled condition of the boards 14 and 16, the heat sink 12 being omitted for the sake of simplicity. It can be seen from this how the same boards 14 and 16 may form an independent module.

In various embodiments, the light source 14*a* may be left uncovered by the circuit board 16, so that the light radiation emitted by the source 14*a* may be diffused freely towards the outside environment without being masked/obscured by the board 16.

The inner edge 160*a* of the aperture 160 has a frame formation 1600 which extends (continuously or discontinuously) along the contour of the aperture 160 protruding towards the inside of the aperture 160 itself.

In various embodiments, the frame formation 1600 may be aligned with the top surface of the board 16.

When the board 14 is inserted inside the aperture 160 (see in particular FIGS. 3 to 5), the outer perimetral edge 140 abuts against the frame formation 1600, so that the board 14 carrying the light source 14*a* is arranged firmly in position inside the aperture 160.

In various embodiments, the peripheral connection between the board 14 (along the edge 140) and the circuit board 16 (along the frame formation 1600) may be made stronger by applying glue (not explicitly visible in the drawings).

In various embodiments, the frame formation 1600 may be provided, in a position facing the outer perimetral edge 140 of the board 14, with an indentation 1600*a*—visible in FIG. 2—so as to form a seat for receiving this glue.

The reference number 16*b* denotes openings (for example four in number, located at the corners of the aperture 160) for receiving screws 18 (or similar fixing means) which allow the drive board 16 to be fixed on the heat sink 18 with the board 14 firmly sandwiched between them (namely between the drive board 16 and the heat sink 18).

Figure 3:
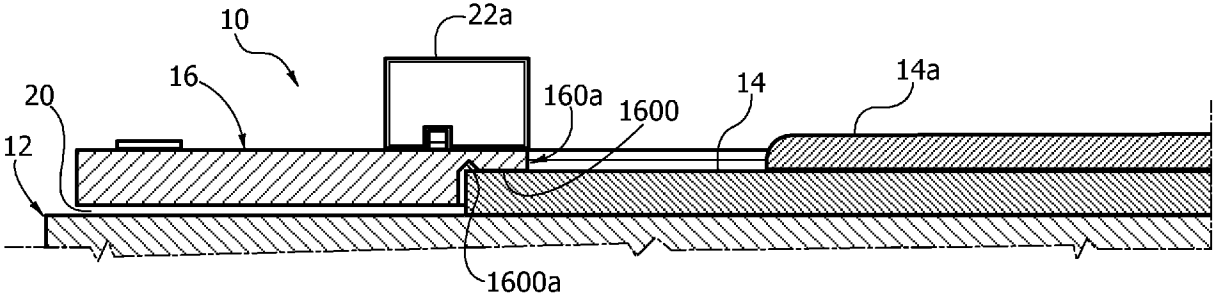
FIG. 3 is a substantially cross-sectional view along the line III-III of FIG. 1, reproduced on an enlarged scale.

Observing the cross-sectional view of FIG. 3, it can be seen that, in various embodiments, the thickness of the board 14 is chosen depending on the thickness of the board 16 (in particular as regards the positioning and thickness of the frame formation 1600) such that the board 14 carrying the light source 14*a* is, as it were, "thicker" or "higher" than the depth of the aperture 1600 defined by the positioning and depth of the frame formation 1600.

In this way, a gap or clearance 20 is formed between the bottom side of the board 16 and the top surface of the heat sink 12—see in particular FIG. 3.

Owing to the presence of the clearance 20, the board 14 with the light source 14*a* (for example made using CoB technology) can be pressed by the board 16 against the surface of the heat sink 12, minimizing the thermal resistance and optimizing the heat dissipation flow from the source 14*a* towards the sink 12.

At the same time, the mounting solution shown is able to ensure a precise mechanical connection, which takes up any working tolerances.

FIGS. 3 to 5 illustrate the possibility, in various embodiments, of providing electrical contacts 22, for example of the spring-loaded type, acting between the drive board 16 and the board 14 carrying the light source 14*a*, for example allowing the electrical connection between metallization strips or tracks provided on these boards.

In various embodiments, these contacts may have a coil-like—for example C-shaped—form and be arranged astride the board 16 and the board 14, for example with end loops resting (directly or by means of projecting side lugs, see for example FIGS. 3 and 4) on the board 16 and on the board 14, respectively.

In various embodiments, the contacts 22 may be arranged inside interruptions in the frame formation 1600 (see for example the interruptions indicated by 1600*b* in FIG. 2, in FIG. 4 and in FIG. 5).

In various embodiments, the contacts 22 may be mounted inside protective casings 22*a* able to act as mounting elements for the contacts 22. In various embodiments, fixing of the contacts 22 on the board 16 may instead be performed by means of the aforementioned side lugs of these contacts 22, in which case the casings 22*a* perform principally only a covering function While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting assembly, comprising:

a heat sink having a mounting surface for a light source;

a light source board having said light source mounted thereon, said light source board being arranged against said mounting surface of said heat sink and having an outer perimeter edge, and a drive board carrying drive circuitry for said light source, said drive board being fixed onto said heat sink with said light source board sandwiched between said heat sink and said drive board, said drive board having an aperture with an inner edge complementary to said outer edge of said light source board, whereby said light source is left uncovered by said drive board, and wherein:

said inner edge of said drive board has an inwardly protruding frame formation with said outer perimeter edge of said light source board abutting against said frame formation, and said light source board has a thickness whereby said drive board and said mounting surface of said heat sink have a clearance therebetween.

2. The lighting assembly of claim 1, comprising glue interposed between said frame formation and said outer perimeter edge of said light source board abutting thereagainst.

3. The lighting assembly of claim 1, comprising an indentation extending along said frame formation facing said outer perimeter edge of said light source board.

4. The lighting assembly of claim 3, comprising glue accommodated in said indentation.

5. The lighting assembly of claim 1, comprising screw fixing means fixing said drive board onto said heat sink.

6. The lighting assembly of claim 1, comprising electrical connections between said drive board and said light source board.

7. The lighting assembly of claim 6, wherein said frame formation has interruptions with said electrical connections extending at said interruptions.

8. The lighting assembly of claim 6, wherein said electrical connections include coiled electrical contacts having end loops facing said drive board and said light source board, respectively.

9. The lighting assembly of claim 1, wherein said light source board and said light source mounted thereon are in the form of a chip-on-board light source.

10. A method of producing a lighting assembly, comprising:

providing a heat sink having a mounting surface for a light source;

providing a light source board having said light source mounted thereon, by arranging said light source board against said mounting surface of said heat sink, wherein said light source board has an outer perimeter edge, and fixing a drive board carrying drive circuitry for said light source onto said heat sink with said light source board sandwiched between said heat sink and said drive board, said drive board having an aperture with an inner edge complementary to said outer edge of said light source board, whereby said light source is left uncovered by said drive board, and wherein:

said inner edge of said drive board has an inwardly protruding frame formation with said outer perimeter edge of said light source board abutting against said frame formation, and said light source board has a thickness whereby said drive board and said mounting surface of said heat sink have a clearance therebetween.

11. A lighting assembly, comprising:

a heat sink having a mounting surface for a light source;

a light source board having said light source mounted thereon, said light source board being arranged against said mounting surface of said heat sink and having an outer perimeter edge, and a drive board carrying drive circuitry including processing circuits for said light source, said drive board being fixed onto said heat sink with said light source board sandwiched between said heat sink and said drive board, said drive board having an aperture with an inner edge complementary to said outer edge of said light source board, whereby said light source is left uncovered by said drive board, and wherein:

said inner edge of said drive board has an inwardly protruding frame formation with said outer perimeter edge of said light source board abutting against said frame formation, and said light source board has a thickness whereby said drive board and said mounting surface of said heat sink have a clearance therebetween.

12. The lighting assembly of claim 11, comprising glue interposed between said frame formation and said outer perimeter edge of said light source board abutting thereagainst.

13. The lighting assembly of claim 11, comprising an indentation extending along said frame formation facing said outer perimeter edge of said light source board.

14. The lighting assembly of claim 13, comprising glue accommodated in said indentation.

15. The lighting assembly of claim 11, comprising screw fixing means fixing said drive board onto said heat sink.

16. The lighting assembly of claim 11, comprising electrical connections between said drive board and said light source board.

17. The lighting assembly of claim 16, wherein said frame formation has interruptions with said electrical connections extending at said interruptions.

18. The lighting assembly of claim 16, wherein said electrical connections include coiled electrical contacts having end loops facing said drive board and said light source board, respectively.

19. The lighting assembly of claim 11, wherein said light source board and said light source mounted thereon are in the form of a chip-on-board light source.

* * * * *